US007200070B2

(12) United States Patent
Hall et al.

(10) Patent No.: US 7,200,070 B2
(45) Date of Patent: Apr. 3, 2007

(54) DOWNHOLE DRILLING NETWORK USING BURST MODULATION TECHNIQUES

(75) Inventors: David R. Hall, Provo, UT (US); Joe Fox, Spanish Fork, UT (US)

(73) Assignee: IntelliServ, Inc., Provo, UT (US)

( * ) Notice: Subject to any disclaimer, the term of this patent is extended or adjusted under 35 U.S.C. 154(b) by 359 days.

(21) Appl. No.: 10/710,769

(22) Filed: Aug. 2, 2004

(65) Prior Publication Data

US 2005/0285751 A1 Dec. 29, 2005

Related U.S. Application Data

(63) Continuation-in-part of application No. 10/878,145, filed on Jun. 28, 2004.

(51) Int. Cl.
*G01U 3/00* (2006.01)

(52) U.S. Cl. ..... 367/81; 340/853.3; 340/855.4

(58) Field of Classification Search ..... 340/853.3, 340/855.4, 853.2; 367/81; 166/72; 370/321
See application file for complete search history.

(56) References Cited

U.S. PATENT DOCUMENTS

| | | | | |
|---|---|---|---|---|
| 2,633,414 | A | 3/1953 | Boivinet | |
| 2,982,360 | A | 5/1961 | Morton et al. | |
| 4,232,197 | A * | 11/1980 | Acampora et al. | 370/321 |
| 4,330,857 | A * | 5/1982 | Alvarez et al. | 370/321 |
| 4,332,026 | A * | 5/1982 | Alvarez et al. | 370/347 |
| 5,311,661 | A | 5/1994 | Zifferer | |
| 5,331,318 | A * | 7/1994 | Montgomery | 340/855.4 |
| 5,517,843 | A | 5/1996 | Winship | |
| 5,850,369 | A | 12/1998 | Rorden et al. | |
| 5,889,765 | A * | 3/1999 | Gibbs | 370/310.2 |
| 5,959,547 | A * | 9/1999 | Tubel et al. | 340/853.2 |
| 6,392,317 | B1 | 5/2002 | Hall et al. | |
| 6,657,551 | B2 | 12/2003 | Huckaba et al. | |
| 6,670,880 | B1 | 12/2003 | Hall et al. | |
| 6,717,501 | B2 | 4/2004 | Hall et al. | |
| 6,735,633 | B1 | 5/2004 | Welch et al. | |
| 6,763,391 | B1 | 7/2004 | Ludtke | |
| 6,799,632 | B2 | 10/2004 | Hall et al. | |
| 6,816,456 | B1 | 11/2004 | Tse-Au | |
| 6,820,117 | B1 | 11/2004 | Johnson | |
| 6,821,147 | B1 | 11/2004 | Hall et al. | |
| 6,830,467 | B2 | 12/2004 | Hall et al. | |
| 6,842,463 | B1 | 1/2005 | Drwiega et al. | |
| 6,844,498 | B2 | 1/2005 | Hall et al. | |
| 6,888,473 | B1 | 5/2005 | Hall et al. | |

(Continued)

OTHER PUBLICATIONS

U.S. Appl. No. 60/383,243, filed May 24, 2002.*

(Continued)

*Primary Examiner*—Albert K. Wong
(74) *Attorney, Agent, or Firm*—Daniel P. Nelson; Tyson J. Wilde; Jeffery E. Daly

(57) ABSTRACT

A downhole drilling system is disclosed in one aspect of the present invention as including a drill string and a transmission line integrated into the drill string. Multiple network nodes are installed at selected intervals along the drill string and are adapted to communicate with one another through the transmission line. In order to efficiently allocate the available bandwidth, the network nodes are configured to use any of numerous burst modulation techniques to transmit data.

20 Claims, 11 Drawing Sheets

U.S. PATENT DOCUMENTS

| | | | | |
|---|---|---|---|---|
| 6,913,093 | B2 | 7/2005 | Hall et al. | |
| 6,929,493 | B2 | 8/2005 | Hall et al. | |
| 6,931,011 | B2 | 8/2005 | Giacopelli et al. | |
| 6,944,188 | B2 * | 9/2005 | Sinha et al. | 370/503 |
| 6,945,802 | B2 | 9/2005 | Hall et al. | |
| 6,954,800 | B2 * | 10/2005 | Mallory | 709/240 |
| 7,000,031 | B2 * | 2/2006 | Fischer et al. | 709/248 |
| 2002/0101359 | A1 | 8/2002 | Hall et al. | |
| 2003/0011489 | A1 | 1/2003 | Viawanathan | |
| 2004/0039466 | A1 | 2/2004 | Lilly et al. | |
| 2004/0085988 | A1 | 5/2004 | Gardner et al. | |
| 2004/0104797 | A1 | 6/2004 | Hall et al. | |
| 2004/0113808 | A1 | 6/2004 | Hall et al. | |
| 2004/0146492 | A1 | 7/2004 | Hall et al. | |
| 2004/0150532 | A1 | 8/2004 | Hall et al. | |
| 2004/0164833 | A1 | 8/2004 | Hall et al. | |
| 2004/0164838 | A1 | 8/2004 | Hall et al. | |
| 2004/0216847 | A1 | 11/2004 | Hall et al. | |
| 2004/0244916 | A1 | 12/2004 | Hall et al. | |
| 2004/0244964 | A1 | 12/2004 | Hall et al. | |
| 2004/0246142 | A1 | 12/2004 | Hall et al. | |
| 2005/0001735 | A1 | 1/2005 | Hall et al. | |
| 2005/0001736 | A1 | 1/2005 | Hall et al. | |
| 2005/0001738 | A1 | 1/2005 | Hall et al. | |
| 2005/0035874 | A1 | 2/2005 | Hall et al. | |
| 2005/0035875 | A1 | 2/2005 | Hall et al. | |
| 2005/0035876 | A1 | 2/2005 | Hall et al. | |
| 2005/0036507 | A1 | 2/2005 | Hall et al. | |
| 2005/0039912 | A1 | 2/2005 | Hall et al. | |
| 2005/0045339 | A1 | 3/2005 | Hall et al. | |
| 2005/0046586 | A1 | 3/2005 | Hall et al. | |
| 2005/0046588 | A1 | 3/2005 | Hall et al. | |
| 2005/0046590 | A1 | 3/2005 | Hall et al. | |
| 2005/0067159 | A1 | 3/2005 | Hall et al. | |
| 2005/0070144 | A1 | 3/2005 | Hall et al. | |
| 2005/0082092 | A1 | 4/2005 | Hall et al. | |
| 2005/0092499 | A1 | 5/2005 | Hall et al. | |
| 2005/0093296 | A1 | 5/2005 | Hall et al. | |
| 2005/0095827 | A1 | 5/2005 | Hall et al. | |
| 2005/0115717 | A1 | 6/2005 | Hall et al. | |
| 2005/0118848 | A1 | 6/2005 | Hall et al. | |
| 2005/0145406 | A1 | 7/2005 | Hall et al. | |
| 2005/0150653 | A1 | 7/2005 | Hall et al. | |
| 2005/0161215 | A1 | 7/2005 | Hall et al. | |
| 2005/0173128 | A1 | 8/2005 | Hall et al. | |
| 2005/0212530 | A1 | 9/2005 | Hall et al. | |
| 2005/0236160 | A1 | 10/2005 | Hall et al. | |

OTHER PUBLICATIONS

PCT/US03/16475, Published Dec. 4, 2003, Applicant Baker Hughes; International Search Report, "Documents Considered to Be Relevant".

* cited by examiner

DOWNHOLE DRILLING NETWORK USING BURST MODULATION TECHNIQUES

CROSS REFERENCE TO RELATED APPLICATIONS

The present application is a continuation-in-part of copending U.S. patent application Ser. No. 10/878,145 filed on Jun. 28, 2004, which is herein incorporated by reference.

FEDERAL RESEARCH STATEMENT

This invention was made with government support under Contract No. DE-FC26-01NT41229 awarded by the U.S. Department of Energy. The government has certain rights in the invention.

BACKGROUND OF INVENTION

1. Field of the Invention

This invention relates to oil and gas drilling, and more particularly to apparatus and methods for transmitting data in downhole drilling networks.

2. Background of the Invention

The goal of accessing data from a drill string has been expressed for more than half a century. As exploration and drilling technology has improved, this goal has become more important in the industry for successful oil, gas, and geothermal well exploration and production. For example, to take advantage of the several advances in the design of various tools and techniques for oil and gas exploration, it would be beneficial to have real time data such as temperature, pressure, inclination, salinity, etc. Several attempts have been made to devise a successful system for accessing such drill string data. However, due to the complexity, expense, and unreliability of such systems, many attempts to create such a system have failed to achieve significant commercial acceptance.

In U.S. Pat. No. 6,670,880 issued to Hall et al. (the "Hall patent"), the inventors disclosed a "downhole transmission system" that overcomes many of the problems and limitations of the prior art. In that system, data is transmitted in real time along the drill string by way of network hardware integrated directly into the drill string. This network hardware enables high-speed communication between various tools and sensors, located along the drill string, with surface analysis, diagnostic, and control equipment.

Because the Hall patent solves many of the problems of the prior art by providing a reliable a high-speed connection between downhole drilling components and the surface, novel apparatus and methods are needed to use the connection efficiently. That is, as is currently the case in most transmission systems, bandwidth is limited by the communication hardware involved. Moreover, although the technology described in the Hall patent is a colossal improvement over prior telemetry systems, it is conceivable that the vast array of downhole tools and sensors used in downhole drilling could generate enough data to consume most of the available bandwidth, thereby significantly limiting the number and types of devices that could be connected to the network.

In some cases, bandwidth may be unnecessarily consumed due to inefficient bandwidth allocation. For example, bandwidth may be consumed by needlessly transmitting raw data over the network at times or in quantities that are not needed. In other cases, various downhole components may completely occupy a transmission channel even though data is only transmitted over the channel intermittently. In yet other cases, large amounts of raw data may be transmitted over the network when a much smaller amount of processed data would be sufficient. The foregoing examples, although not an exhaustive list, are illustrative of various ways that the bandwidth of a downhole network may be used inefficiently.

Therefore, in response to various needs felt in the downhole drilling industry, what are needed are apparatus and methods for effectively allocating bandwidth in high-speed downhole telemetry systems. What are further needed are apparatus and methods for effectively sharing bandwidth between downhole devices that transmit data in an inconsistent or intermittent manner. What are further needed are apparatus and methods for efficiently acquiring and receiving signals that are transmitted intermittently or sporadically, in order to conserve bandwidth.

SUMMARY OF INVENTION

In view of the foregoing, the present invention relates to apparatus and methods for effectively allocating bandwidth in high-speed downhole telemetry systems. The present invention further relates to apparatus and methods for effectively sharing bandwidth between downhole devices that transmit data in an inconsistent or intermittent manner. Finally, the present invention relates to apparatus and methods for efficiently acquiring and receiving signals that are transmitted intermittently or sporadically in order to conserve or effectively use bandwidth.

Consistent with the foregoing, and in accordance with the invention as embodied and broadly described herein, a downhole drilling system is disclosed in one aspect of the present invention as including a drill string and a transmission line integrated into the drill string. Multiple network nodes are installed at selected intervals along the drill string and are adapted to communicate with one another through the transmission line. In order to efficiently allocate the available bandwidth, the network nodes are configured to use any of numerous burst modulation techniques to transmit data.

In certain embodiments of the invention, the network nodes include burst modems configured to transmit data packets over the transmission line. These burst modems may include automatic gain control mechanisms to automatically adjust the gain of data packets received by the network nodes. In selected embodiments, the data packets include a preamble. This preamble may include an unmodulated carrier portion to enable the burst modems to estimate the carrier frequency of an incoming data packet. The preamble may also include a timing sequence portion to enable the burst modems to estimate the timing of symbols in the data packet. In selected embodiments, the preamble may further include a unique code to enable the burst modems to detect the start of a data packet transmitted over the transmission line.

The burst modems may use any suitable type of burst modulation technique to compress and transmit data, including but not limited to burst quadrature phase shift keying, burst quadrature amplitude modulation, burst amplitude shift keying, burst phase shift keying, burst on-off keying, burst pulse code modulation, burst frequency shift keying, burst pulse amplitude modulation, burst pulse position modulation, burst pulse duration modulation, burst phase modulation, burst pulse duration modulation, burst pulse width modulation, or combinations thereof.

BRIEF DESCRIPTION OF DRAWINGS

The foregoing and other features of the present invention will become more fully apparent from the following description, taken in conjunction with the accompanying drawings. Understanding that these drawings depict only typical embodiments in accordance with the invention and are, therefore, not to be considered limiting of its scope, the invention will be described with additional specificity and detail through use of the accompanying drawings.

DETAILED DESCRIPTION

It will be readily understood that the components of the present invention, as generally described and illustrated in the Figures herein, could be arranged and designed in a wide variety of different configurations. Thus, the following more detailed description of embodiments of apparatus and methods of the present invention, as represented in the Figures, is not intended to limit the scope of the invention, as claimed, but is merely representative of various selected embodiments of the invention.

The illustrated embodiments of the invention will be best understood by reference to the drawings, wherein like parts are designated by like numerals throughout. Those of ordinary skill in the art will, of course, appreciate that various modifications to the apparatus and methods described herein may easily be made without departing from the essential characteristics of the invention, as described in connection with the Figures. Thus, the following description of the Figures is intended only by way of example, and simply illustrates certain selected embodiments consistent with the invention as claimed herein.

Many of the functional units described in this specification have been labeled as modules, in order to more particularly emphasize their implementation independence. For example, modules may be implemented in software for execution by various types of processors. An identified module of executable code may, for instance, comprise one or more physical or logical blocks of computer instructions that may, for instance, be organized as an object, procedure, or function. Nevertheless, the executables of an identified module need not be physically located together, but may comprise disparate instructions stored in different locations which, when joined logically together, comprise the module and achieve the stated purpose for the module. For example, a module of executable code could be a single instruction, or many instructions, and may even be distributed over several different code segments, among different programs, and across several memory devices.

Modules may also be implemented in hardware as electronic circuits comprising custom VLSI circuitry, off-the-shelf semiconductors such as logic chips, transistors, or other discrete components. A module may also be implemented in programmable hardware devices such as field programmable gate arrays, programmable array logic, programmable logic devices, or the like. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

Figure 1:
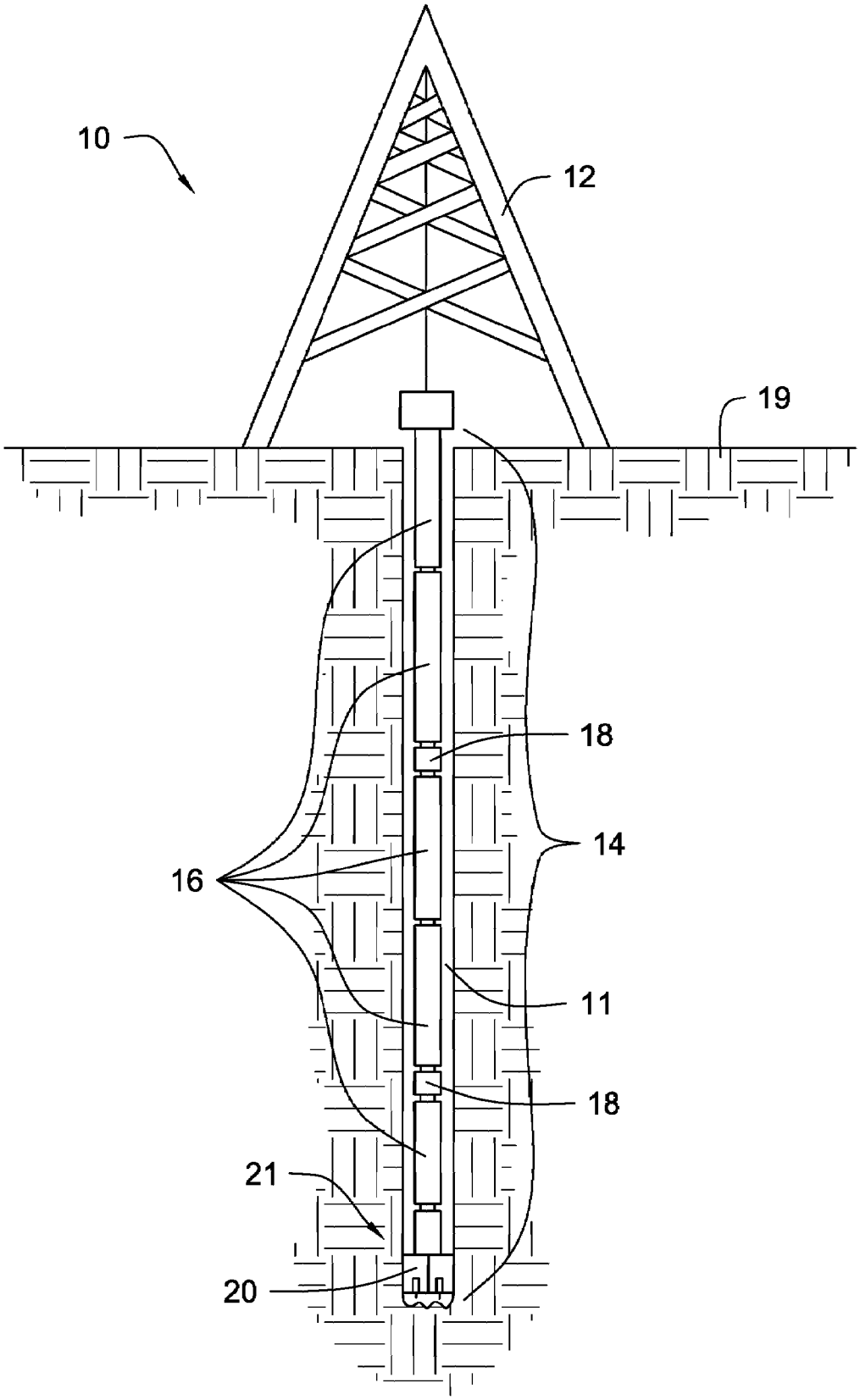
FIG. 1 is a profile view of one embodiment of a drill rig and drill string in accordance with the invention.

Referring to FIG. 1, a drill rig 10 may include a derrick 12 and a drill string 14 comprised of multiple sections of drill pipe and other downhole tools 16. The drill string 14 is typically rotated by the drill rig 10 to turn a drill bit 20 that is loaded against the earth 19 to form a borehole 11. Rotation of the drill bit 20 may alternately be provided by other downhole tools such as drill motors, or drill turbines (not shown) located adjacent to the drill bit 20.

A bottom-hole assembly 21 may include a drill bit 20, sensors, and other downhole tools such as logging-while-drilling ("LWD") tools, measurement-while-drilling ("MWD") tools, diagnostic-while-drilling ("DWD") tools, or the like. Other downhole tools may include heavyweight drill pipe, drill collar, stabilizers, hole openers, sub-assemblies, under-reamers, rotary steerable systems, drilling jars, drilling shock absorbers, and the like, which are all well known in the drilling industry.

While drilling, a drilling fluid is typically supplied under pressure at the drill rig 10 through the drill string 14. The drilling fluid typically flows downhole through the central bore of the drill string 14 and then returns uphole to the drill rig 10 through the annulus 11. Pressurized drilling fluid is circulated around the drill bit 20 to provide a flushing action to carry the drilled earth cuttings to the surface.

Figure 2:
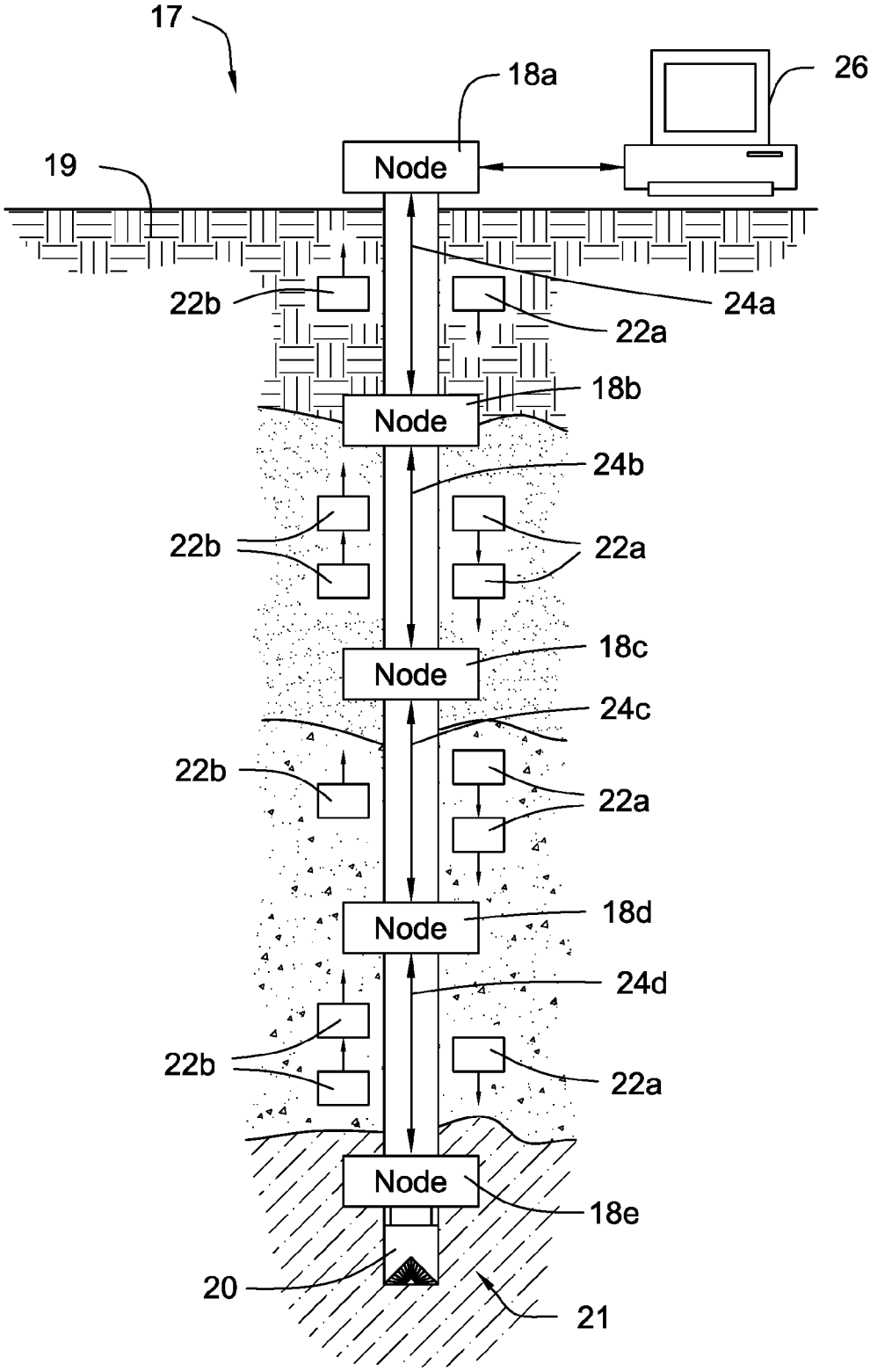
FIG. 2 is a schematic block diagram illustrating one embodiment of a downhole network in accordance with the invention, integrated into the drill string.

Referring to FIG. 2, while continuing to refer generally to FIG. 1, in selected embodiments, a downhole network 17 may be used to transmit information along the drill string 14. The downhole network 17 may include multiple nodes 18*a–e* spaced at desired intervals along the drill string 14. The nodes 18*a–e* may be intelligent computing devices

18*a–e*, such as routers, or may be less intelligent connection devices, such as hubs, switches, repeaters, or the like, located along the length of the network 17. Each of the nodes 18 may or may not have a network address. A node 18*e* may be located at or near the bottom hole assembly 21. The bottom hole assembly 21 may include a drill bit 20, drill collar, and other downhole tools and sensors designed to gather data, perform various functions, or the like.

Other intermediate nodes 18*b–d* may be located or spaced along the network 17 to act as relay points for signals traveling along the network 17 and to interface to various tools or sensors located along the length of the drill string 14. Likewise, a top-hole node 18*a* may be positioned at the top or proximate the top of the drill string 14 to interface to an analysis device, such as a personal computer 26.

Communication links 24*a–d* may be used to connect the nodes 18*a–e* to one another. The communication links 24*a–d* may consist of cables or other transmission media integrated directly into the tools 16 making up the drill string 14, routed through the central bore of the drill string 14, or routed external to the drill string 14. Likewise, in certain embodiments, the communication links 24*a–d* may be wireless connections. In selected embodiments, the downhole network 17 may function as a packet-switched or circuit-switched network 17.

To transmit data along the drill string 14, packets 22*a*, 22*b* may be transmitted between the nodes 18*a–e*. Some packets 22*b* may carry data gathered by downhole tools or sensors to uphole nodes 18*a*, or may carry protocols or data necessary to the function of the network 17. Likewise, other packets 22*a* may be transmitted from uphole nodes 18*a* to downhole nodes 18*b–e*. For example, these packets 22*a* may be used to carry control signals or programming data from a top-hole node 18*a* to tools or sensors interfaced to various downhole nodes 18*b–e*. Thus, a downhole network 17 may provide a high-speed means for transmitting data and information between downhole components and devices located at or near the earth's surface 19.

Figure 3:
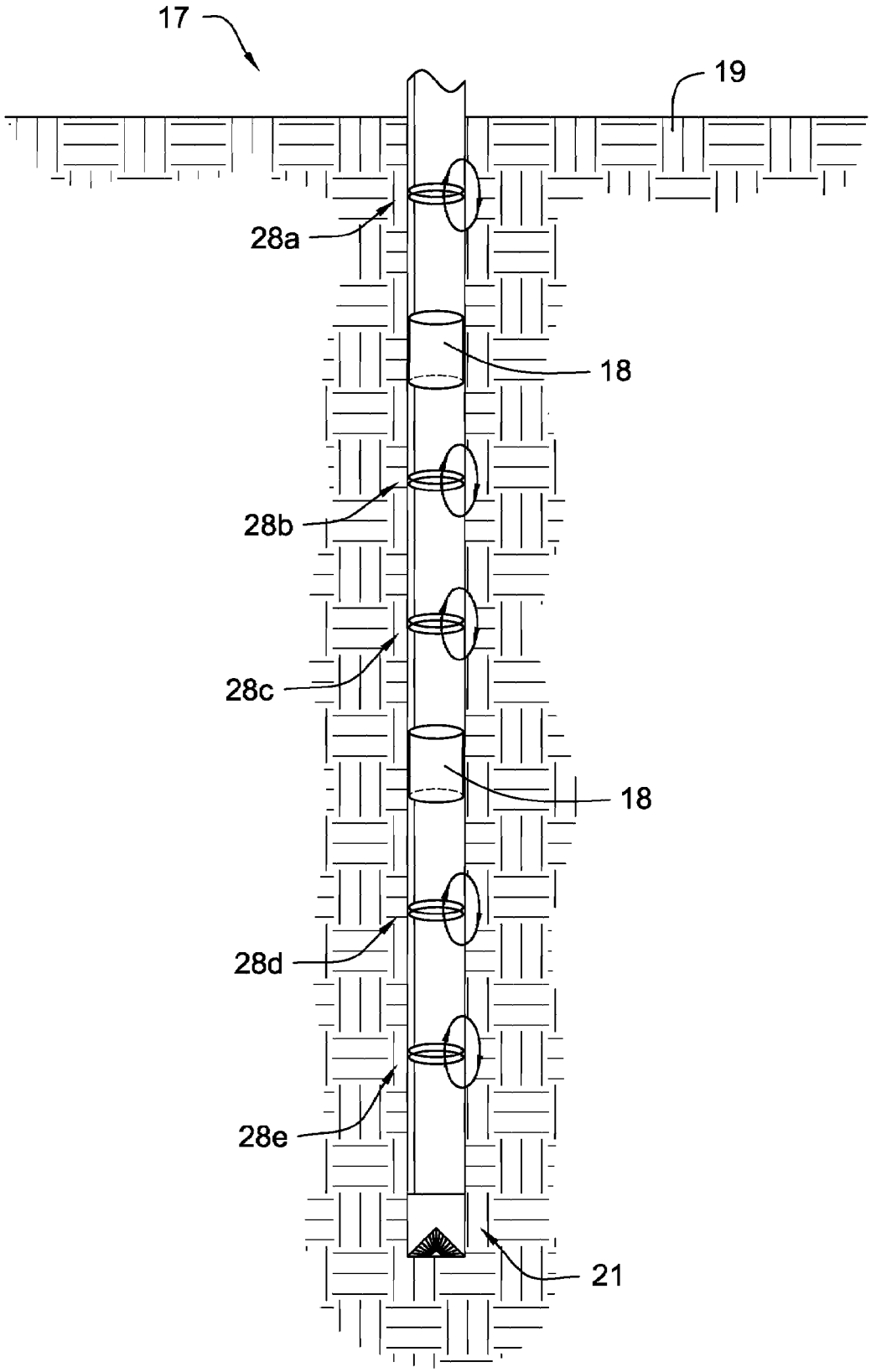
FIG. 3 is a schematic block diagram illustrating one method of transmitting data along the drill string.

Referring to FIG. 3, in one embodiment, a downhole network 17 in accordance with the invention may include various nodes 18 spaced at selected intervals along the drill string 14. Each of the nodes 18 may communicate with a bottom-hole assembly 21. As data travels along the network 17, transmission elements 28*a–e* may be used to transmit data across the tool joints. For information regarding one embodiment of suitable transmission elements 28*a–e*, the reader is referred to the Hall patent, U.S. Pat. No. 6,670,880, which is herein incorporated by reference.

In the Hall patent, inductive coils are used to transmit data signals across the tool joints. As described therein, a first inductive coil converts an electrical current to a magnetic field that is communicated across the tool joint. A second inductive coil detects the magnetic field and converts the magnetic field back to an electrical current. This allows a data signal to be transmitted across a tool joint even absent a reliable electrical connection. Nevertheless, in other embodiments, the transmission elements 28*a–e* may also transmit data across the tool joint through direct contact. See Hall et al application Ser. No. 10/605,493, filed Oct. 2, 2004, incorporated herein by this reference.

Figure 4:
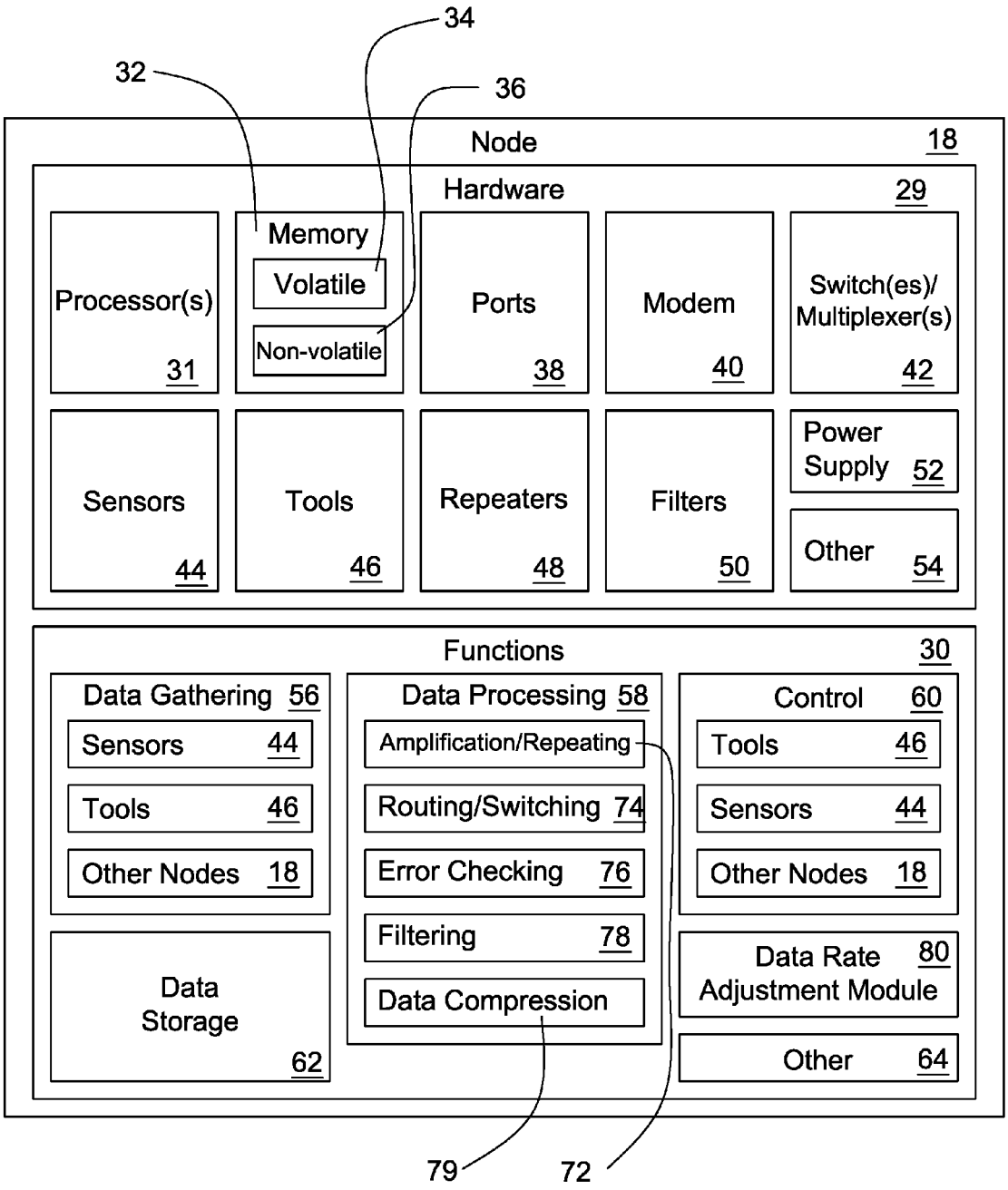
FIG. 4 is a schematic block diagram illustrating various types of hardware and software modules that may be included in a network node in accordance with the invention.

Referring to FIG. 4, a network node 18 in accordance with the invention may include a combination of hardware 29 and software providing various functions 30. The functions 30 may be provided strictly by the hardware 29, software executable on the hardware 29, or a combination thereof. For example, hardware 29 may include one or several processors 31 capable of processing data as well as executing instructions. The processor 31 or processors 31 may include hardware such as busses, clocks, cache, or other supporting hardware.

Likewise, the hardware 29 may include volatile 34 and non-volatile 36 memories 32 to store data and provide staging areas for data transmitted between hardware components 29. Volatile memory 34 may include random access memory (RAM), or equivalents thereof, providing high-speed memory storage. Memory 32 may also include selected types of non-volatile memory 36 such as read-only-memory (ROM), PROM, EEPROM, or the like, or other long-term storage devices, such as hard drives, floppy disks, flash memory, or the like. Ports 38 such as serial ports, parallel ports, or the like, may be used to interface to other devices connected to the node 18, such as various sensors or tools located proximate the node 18.

A modem 40 may be used to modulate digital data onto an analog carrier signal for transmission over network cable or other transmission media, and likewise, demodulate the analog signals when received. A modem 40 may include various built in features including but not limited to error checking, data compression, or the like. In addition, the modem 40 may use any suitable modulation type such as ASK, PSK, QPSK, OOK, PCM, FSK, QAM, PAM, PPM, PDM, PWM, or the like, to name a few. The choice of a modulation type may depend on a desired data transmission speed, the bandwidth capability of the network hardware, as well as unique operating conditions that may exist in a downhole environment. Likewise, the modem 40 may be configured to operate in full-duplex, half-duplex, or other mode. The modem 40 may also use any of numerous networking protocols currently available, such as collision-based protocols like Ethernet, token-based, or asynchronous transfer (ATM) protocols.

A node 18 may also include one or several switches 42, multiplexers 42, or both. A switch 42 may filter, forward, and route traffic on the network. Multiplexers 42 (and corresponding demultiplexers 42) may transmit multiple signals over a single communications line or a single channel. The multiplexers 42 may use any known protocol to transmit information over the network 17, including but not limited to frequency-division multiplexing, time-division multiplexing, statistical time-division multiplexing, wave-division multiplexing, code-division multiplexing, spread spectrum multiplexing, or combinations thereof.

A node 18 may also include various downhole tools 46 and sensors 44. These tools 46 and sensors 44 may be integrated into the node 18 (i.e., share the same circuitry) or interface to the node 18 through ports 38. Tools 46 and sensors 44 may include devices such as coring tools, mud logging devices, pore fluid sensors, resistivity sensors, induction sensors, sonic devices, radioactivity sensors, electrical potential tools, temperature sensors, accelerometers, imaging devices, seismic devices, mechanical devices such as caliper tools or free point indicators, pressure sensors, inclinometers, surveying tools, navigation tools, or the like. These tools 46 and sensors 44 may be configured to gather data for analysis uphole, and may also receive data such as control signals, programming data, or the like, from uphole sources. For example, control signals originating at the surface may direct a sensor 44 to take a desired measurement. Likewise, selected tools 46 and sensors 44 may be re-programmed through the network 17 without extracting the tools from the borehole.

A drill string 14 may extend into the earth 20,000 feet or more. As a result, signal loss or attenuation may be a significant factor when transmitting data along the downhole network 17. This signal loss or attenuation may vary according to the network hardware. The reader is referred to the Hall patent for a description of one embodiment of various hardware components that may be used to construct the network 17. For example, a drill string 14 is typically comprised of multiple segments of drill pipe 16 or other drill tools 16. As a result, signal loss may occur each time a signal is transmitted from one downhole tool 16 to another 16. Since a drill string may include several hundred sections of drill pipe 16 or other tools 16, the aggregate attenuation can be significant. Likewise, attenuation may also occur in the cable or other transmission media routed along the drill string 14.

To compensate for signal attenuation, amplifiers 48, or repeaters 48, may be spaced at selected intervals along the network 17. The amplifiers 48 may receive a data signal, amplify it, and transmit it to the next node 18. Like amplifiers 48, repeaters 48 may be used to receive a data signal and retransmit it at higher power. However, unlike amplifiers 48, repeaters 48 may remove noise from the data signal. This may be done by demodulating the data from the transmitted signal and re-modulating it onto a new carrier.

Likewise, a node 18 may include various filters 50. Filters 50 may be used to filter out undesired noise, frequencies, and the like that may be present or introduced into a data signal traveling up or down the network 17. Likewise, the node 18 may include a power supply 52 to supply power to any or all of the hardware 29. The node 18 may also include other hardware 54, as needed, to provide other desired functionality to the node 18.

The node 18 may provide various functions 30 that are implemented by software, hardware, or a combination thereof. For example, the node's functions 30 may include data gathering 56, data processing 58, control 60, data storage 62, or other functions 64. Data may be gathered 56 from sensors 44 located downhole, tools 46, or other nodes 18 in communication with a selected node 18. This data 56 may be transmitted or encapsulated within data packets transmitted up and down the network 17.

Likewise, the node 18 may provide various data processing functions 58. For example, data processing may include data amplification 72 or repeating 72, routing 74 or switching 74 data packets transmitted along the network 17, error checking 76 of data packets transmitted along the network 17, filtering 78 of data, as well as data compression 79 and decompression 79. Likewise, a node 18 may process various control signals 60 transmitted from the surface to tools 46, sensors 44, or other nodes 18 located downhole. Likewise, a node 18 may store data that has been gathered from tools 46, sensors 44, or other nodes 18 within the network 17. Likewise, the node 18 may include other functions 64, as needed.

In selected embodiments, a node 18 may include a data rate adjustment module 80. The data rate adjustment module 80 may monitor network traffic traveling in both uphole and downhole directions. The data rate adjustment module 80 may optimize the network's settings and efficiency by adjusting the allocation of bandwidth for data traveling uphole and downhole. As is typical in most communication systems, data rates may be limited by the available bandwidth of a particular system. For example, in downhole drilling systems, available bandwidth may be limited by the transmission cable, hardware used to communicate across tool joints, electronic hardware in the nodes 18, the downhole environment, or the like. Thus, the data rate adjustment module 80 may efficiently allocate the limited available bandwidth where it is most needed.

For example, in selected embodiments, most of the network traffic may flow from downhole tools 46 and sensors 44 to the surface for analysis. Thus, ordinarily, most of the network bandwidth may be allocated to traffic traveling uphole. Nevertheless, in some circumstances, more bandwidth may be needed for traffic traveling downhole. For example, in some cases, significant downhole bandwidth may be needed when reprogramming downhole tools 46 and sensors 44, or when sending large amounts of control data downhole. In these instances, the data rate adjustment module 80 may adjust the bandwidth to provide additional bandwidth to downhole traffic. In some instances, this may include reducing the allocated bandwidth for uphole traffic. Likewise, when the need for additional downhole bandwidth has abated, the data rate adjustment module 80 may readjust the available bandwidth by re-allocating bandwidth to uphole traffic.

Figure 5:
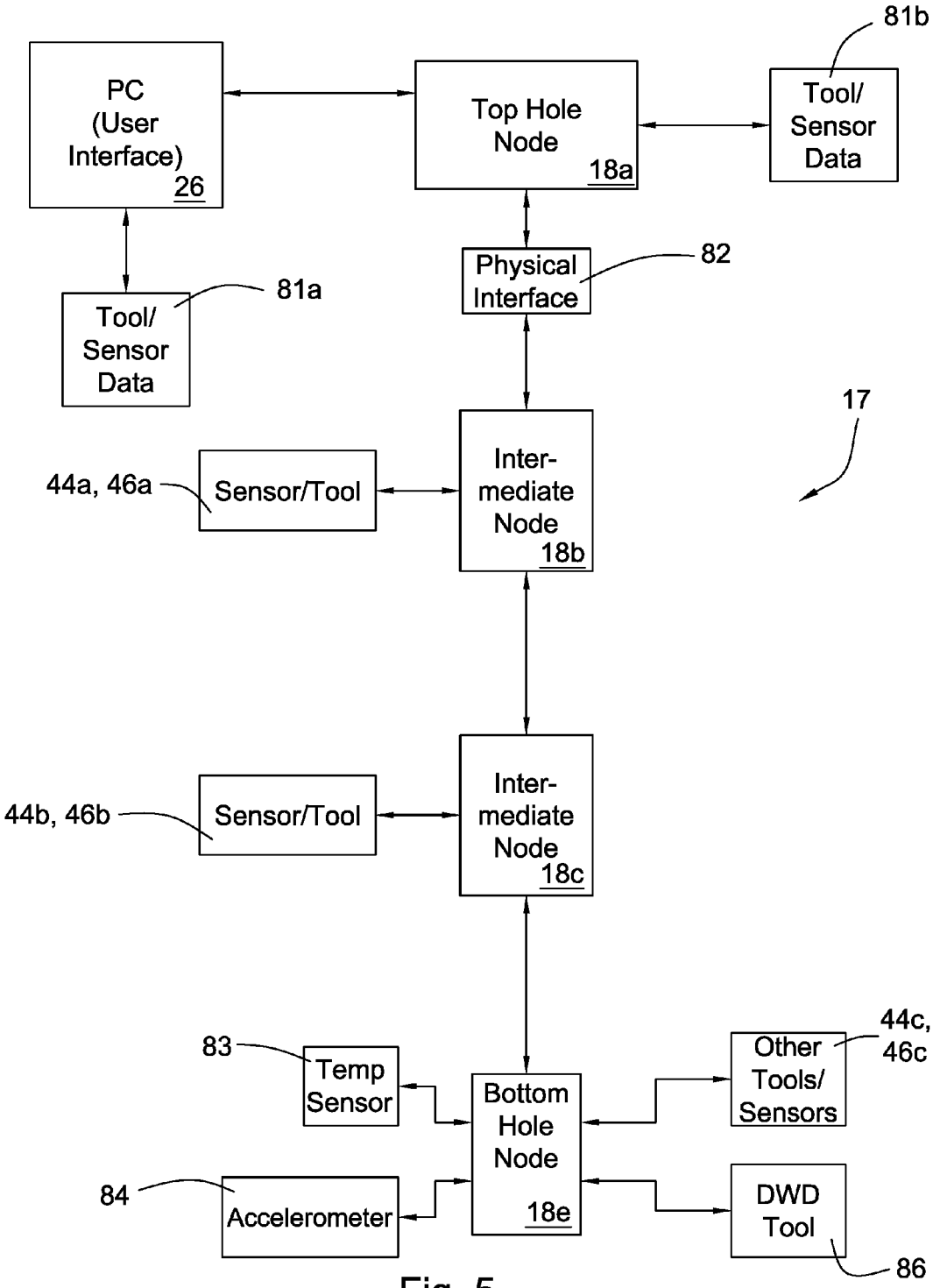
FIG. 5 is a schematic block diagram illustrating one embodiment of a downhole network in accordance with the invention, interfacing with various tools and sensors.

Referring to FIG. 5, in one embodiment, a downhole network 17 in accordance with the invention may include a top-hole node 18*a* and a bottom-hole node 18*e*. A bottom-hole node 18*e* may interface to various components located in or proximate a bottom-hole assembly 21. For example, a bottom-hole node 18*e* may interface to a temperature sensor 83, an accelerometer 84, a DWD (diagnostic-while-drilling) tool 86, or other tools 46*c* or sensors 44*c* such as those listed in the description of FIG. 4.

A bottom-hole node 18*e* may communicate with an intermediate node 18*c* located at an intermediate point along the drill string 14. The intermediate node 18*c* may also provide an interface to tools 46*b* or sensors 44*b* communicating through the network 17. Likewise, other nodes 18, such as a second intermediate node 18*b*, may be located along the drill string 14 to communicate with other sensors 44*a* or tools 46*a*. Any number of intermediate nodes 18*b*, 18*c* may be used along the network 17 between the top-hole node 18*a* and the bottom-hole node 18*e*.

In selected embodiments, a physical interface 82 may be provided to connect network components to a drill string 14. For example, since data may be transmitted directly up the drill string on cables or other transmission media integrated directly into drill pipe 16 or other drill string components 16, the physical interface 82 may provide a physical connection to the drill string so data may be routed off of the drill string 14 to network components, such as a top-hole node 18*a*, or personal computer 26.

For example, a top-hole node 18*a* may be operably connected to the physical interface 82. The top-hole node 18*a* may also be connected to an analysis device such as a personal computer 26. The personal computer 26 may be used to analyze or examine data gathered from various downhole tools 46 or sensors 44. Likewise, tool and sensor data 81*a* may be saved or output from the analysis device 26. Likewise, in other embodiments, tool and sensor data 81*b* may be routed directly off the top-hole node 18*a* for analysis.

Figure 6:
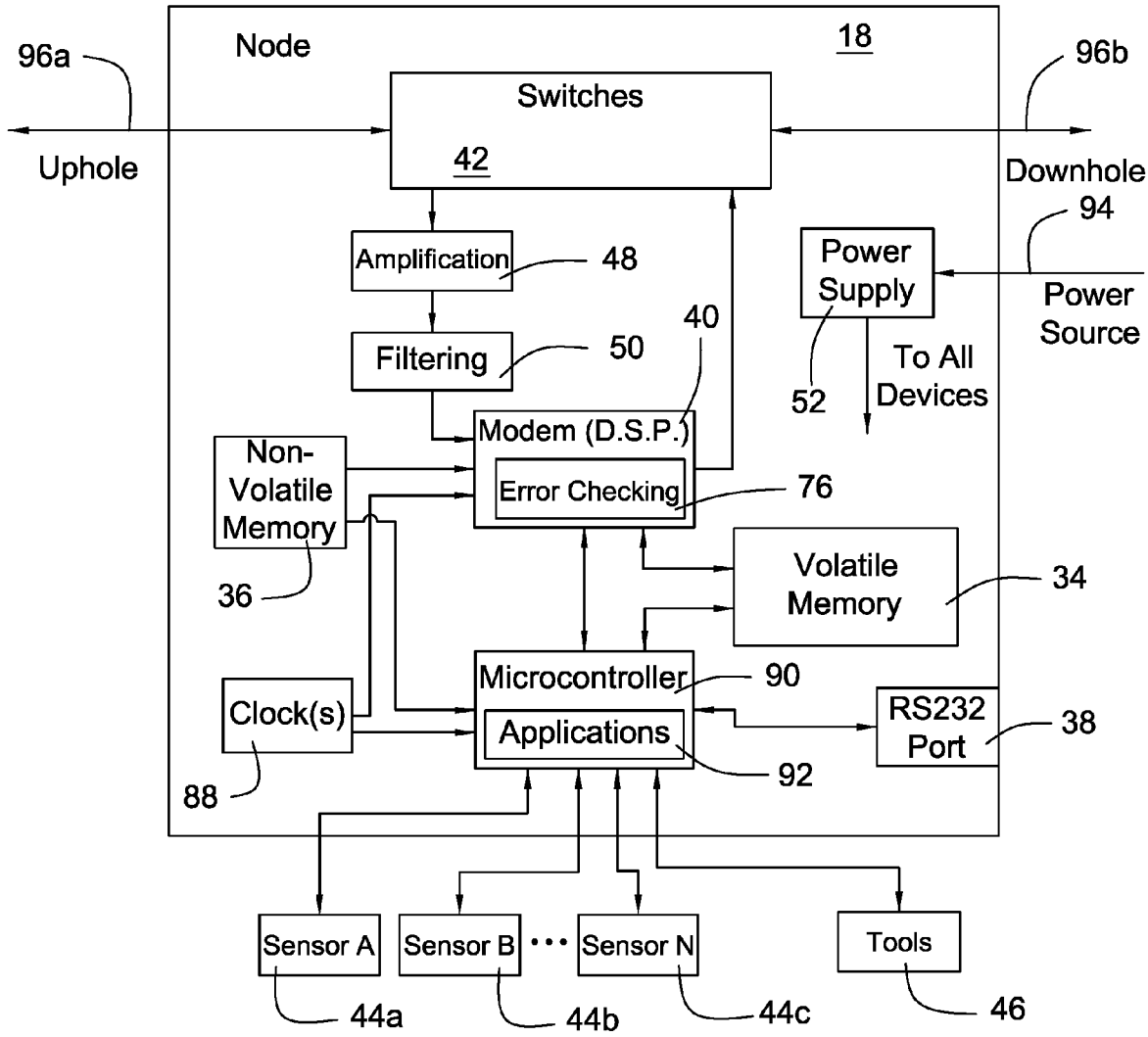
FIG. 6 is a more detailed schematic block diagram illustrating one embodiment of hardware and software components that may be included in a network node in accordance with the invention.

Referring to FIG. 6, in selected embodiments, a node 18 may include various components to provide desired functionality. For example switches 42, multiplexers 42, or a combination thereof may be used to receive, switch, and multiplex or demultiplex signals, received from other uphole 96*a* and downhole 96*b* nodes 18. The switches/multiplexers 42 may direct traffic such as data packets or other signals into and out of the node 18, and may ensure that the packets or signals are transmitted at proper time intervals, frequencies, or combinations thereof.

In certain embodiments, the multiplexer 42 may transmit several signals simultaneously on different carrier frequencies. In other embodiments, the multiplexer 42 may coordinate the time-division multiplexing of several signals. Signals or packets received by the switch/multiplexer 42 may be amplified 48 and filtered 50, such as to remove noise. In certain embodiments received signals may simply be amplified 48. In other embodiments, the signals may be received, data may be demodulated therefrom and stored, and the data may be remodulated and retransmitted on a selected carrier frequency having greater signal strength. A modem 40 may be used to demodulate digital data from signals received from the switch/multiplexer and modulate digital data onto carrier signals for transfer to the switches/multiplexer for transmission uphole or downhole.

The modem 40 may also perform various tasks such as error-checking 76 and data compression. The modem 40 may also communicate with a microcontroller 90. The microcontroller 90 may execute any of numerous applications 92. For example, the microcontroller 90 may run applications 92 whose primary function is to acquire data from one or a plurality of sensors 44*a–c*. For example, the microcontroller 90 may interface to sensors 44 such as inclinometers, thermocouplers, accelerometers, imaging devices, seismic data gathering devices, or other sensors such as those listed in the description of FIG. 4. Thus, the node 18 may include circuitry that functions as a data acquisition tool.

In other embodiments, the microcontroller 90 may run applications 92 that may control various tools 46 or sensors 44 located downhole. That is, not only may the node 18 be used as a repeater, and as a data gathering device, but it may also be used to receive or provide control signals to control selected tools 46 and sensors 44, as needed. The node 18 may also include a volatile memory device 34, such as a FIFO 34 or RAM 34, that may be used to store data needed by or transferred between the modem 40 and the microcontroller 90.

Other components of the node 18 may include non-volatile memory 36, which may be used to store data, such as configuration settings, node addresses, system settings, and the like. One or several clocks 88 may be provided to provide clock signals to the modem 40, the microcontroller 90, or any other device. A power supply 52 may receive power from an external power source 94 such as batteries. The power supply 94 may provide power to any or all of the components located within the node 18. Likewise, an RS232 port 38 may be used to provide a serial connection to the node 18.

Thus, a node 18, as more generally described in FIG. 4, may provide many more functions than those supplied by a simple signal repeater. The node 18 may provide many of the advantages of an addressable node on a local area network. The addressable node may amplify signals received from uphole 96*a* or downhole 96*b* sources, be used as a point of data acquisition, and be used to provide control signals to desired sensors 44 or tools 46. These represent only a few examples of the versatility of the node 18. Thus, the node 18, although useful and functional as a repeater 30, may have a greatly expanded capability.

Figure 7A:
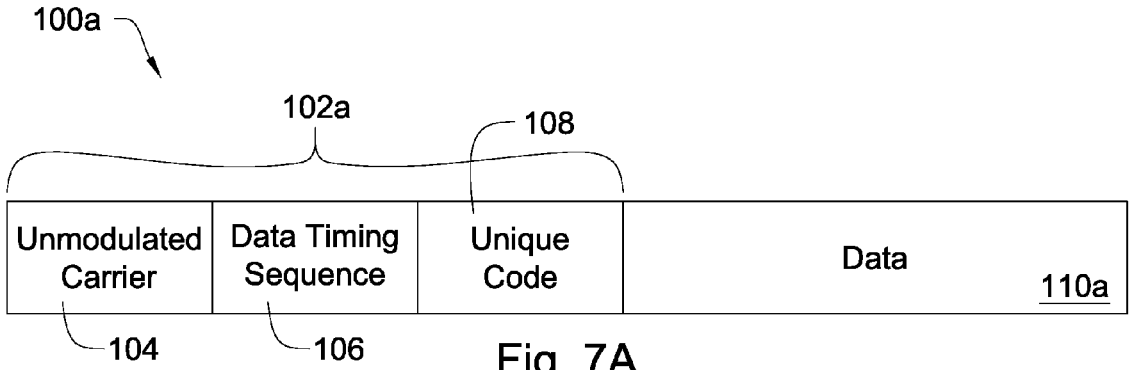
FIG. 7A is a schematic block diagram illustrating one embodiment of a data packet transmitted between nodes in the network.

Referring to FIG. 7A, as the demand for bandwidth grows in a downhole network 17, as it most likely will given the large number of tools and sensor that can be used in a downhole environment, it may be impossible or difficult to provide continuous and efficient connections to many tools and sensors that require high, instantaneous throughput on an intermittent basis. Thus, there is a need in the downhole drilling industry, and more particularly in downhole drilling networks, for downhole networks that share channels by providing access to downhole tools, sensors, or the like, only when needed. These network systems may use a special type of modem called a burst modem to transmit data over the network in short bursts.

In burst modulation schemes, a data packet 100*a* may include a preamble 102*a*. A preamble 102*a* is typically a collection of symbols in the packet 100*a* intended to aid a modem 40 in acquiring, or receiving, the data packet 100*a*. Although the term "preamble" typically indicates that the preamble 102*a* is at the beginning of a packet 100*a*, a "mid-amble" or "post-amble" may also be suitable in certain embodiments, as will be described in more detail hereafter. For the purposes of this specification and the appended claims, the term "preamble" includes acquisition symbols at the beginning, middle, or end of a packet 100*a*.

In selected embodiments, a preamble 102*a* may include three parts: an unmodulated carrier portion 104, a data timing portion 106, and a unique code 108. The unmodulated carrier portion 104 may essentially be an unchanging sequence of symbols arranged to enable a receiving modem 40 to estimate the carrier frequency of the data packet 100*a*. The data timing portion 106 is typically a sequence of symbols configured to make symbol transitions as pronounced as possible. This aids a receiving modem 40 in calculating the timing of symbols in the data packet 100*a*. Finally, the data packet may also include a unique code 108 to aid a modem 40 in detecting the beginning of the data packet 100*a*. A burst modem may detect the unique code 108 by measuring its correlative properties to a bit pattern in the receiving modem 40. As will be discussed in more detail in FIG. 10, various loops in the modem 40 allow the modem to detect the carrier frequency, symbol timing, and beginning of each packet by analyzing the preamble 102.

Figure 7B:
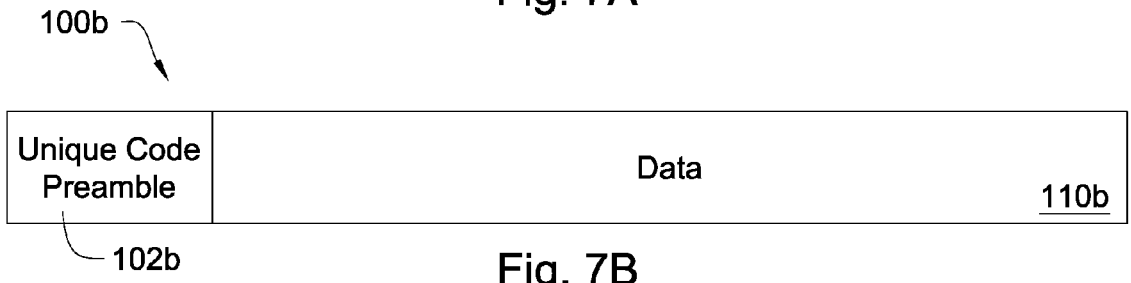
FIG. 7B is a schematic block diagram illustrating another embodiment of a data packet transmitted between nodes in the network.

Referring to FIG. 7B, with the amount of processing power that is currently available in modems using hardware and software, the approach described in FIG. 7A is often unnecessary and may consume more processing overhead than is desired. A good burst modem design may calculate the carrier frequency, symbol timing, start of the packet, and so forth, from a single sequence 102*b*. Usually, if a sequence 102*b* has good correlation properties, it will also be transition rich, which makes the sequence a good source for extracting symbol timing. A burst modem 40 may also strip the symbols of the preamble 102*b* from the carrier to accurately estimate the carrier frequency.

In selected embodiments, the symbols of the preamble 102*b* may be limited to two antipodal values to maximize the transition between symbols. This may improve the modem's ability to calculate the symbol timing. For example, in QAM and QPSK systems, the preamble may be limited to symbols residing on opposites sides of the constellation, essentially reducing the preamble 102*b* to a BPSK (binary phase shift keyed) signal. In QAM schemes, it may be desirable to select a pair of constellation points that have the same average power as the data 110*a–b* using the whole constellation.

The length of the preamble 102*b* may be adjusted, as needed, to optimize signal acquisition. For example, in a downhole drilling network 17, the distance between nodes may be inconsistent. In addition, a signal transmitted along the network 17 may lose a varying amount of power as the signal is transmitted across tool joints. As a result, a downhole network 17 may be subject to a "near/far problem," wherein some bits of the preamble 102*b* are rendered useless before a receiving modem 40 can adjust the gain of the signal 100*b* to fall within the dynamic range of the modem 40. The length of the preamble 102*b* may be adjusted to compensate for this near/far problem. Nevertheless, the preamble 102*b* is preferably designed to be as short as possible, while maintaining favorable bit-to-error ratios, to minimize the amount of processing power used processing the preamble 102*b*.

Figure 7C:
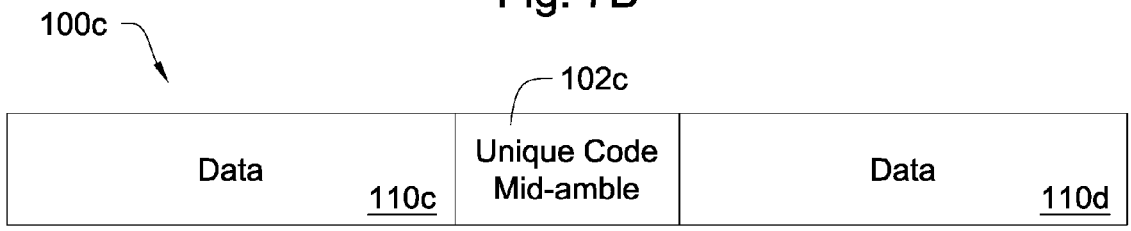
FIG. 7C is a schematic block diagram illustrating another embodiment of a data packet transmitted between nodes in the network.

Referring to FIG. 7C, in selected embodiments, the preamble 102*c* (here referred to as a mid-amble 102*c* may be placed in the middle of the burst 100*c*, or packet 100*c*. This configuration may be useful in systems having time-varying channels because the packet 100*c* only has half of the time to diverge from the location where the frequency and symbol timing samples are taken. In such systems, however, the modem 40 must temporarily store data 110*c* preceding the preamble 102*c* before the estimates are calculated from the preamble 102*c*. Once the preamble 100*c* is analyzed, the preceding and subsequent data 110*c*, 110*d* may be processed.

Figure 7D:
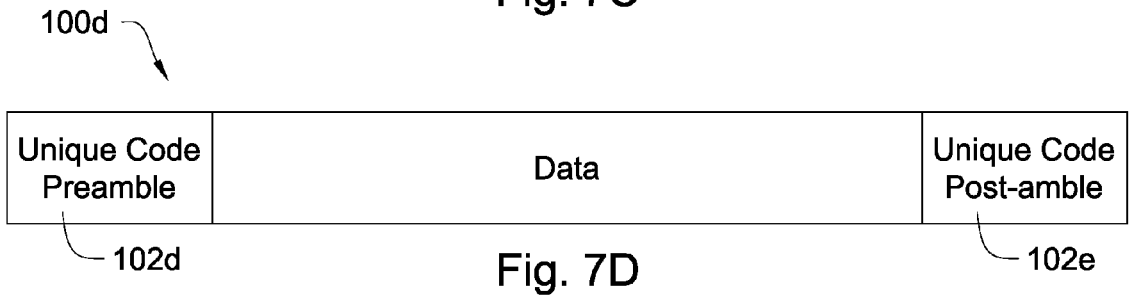
FIG. 7D is a schematic block diagram illustrating yet another embodiment of a data packet transmitted between nodes in the network.

Referring to FIG. 7D, in other embodiments, it may be helpful to place a preamble 102*d* and post-amble 102*e* at both ends of the data packet 100*d* to aid in estimating the carrier frequency and symbol timing. Although not illustrated in FIGS. 7A–7D, the packets 100*a–d* may also include features such as training marks to provide channel equalization, error correction data, source and destination addresses, trailing marks, and the like. One of ordinary skill in the art will recognize that network packets 100*a–d* may take on many forms and contain varied information. Thus, the examples presented herein simply represent various contemplated embodiments in accordance with the invention, and are not intended to limit the scope of the invention.

Figure 8:
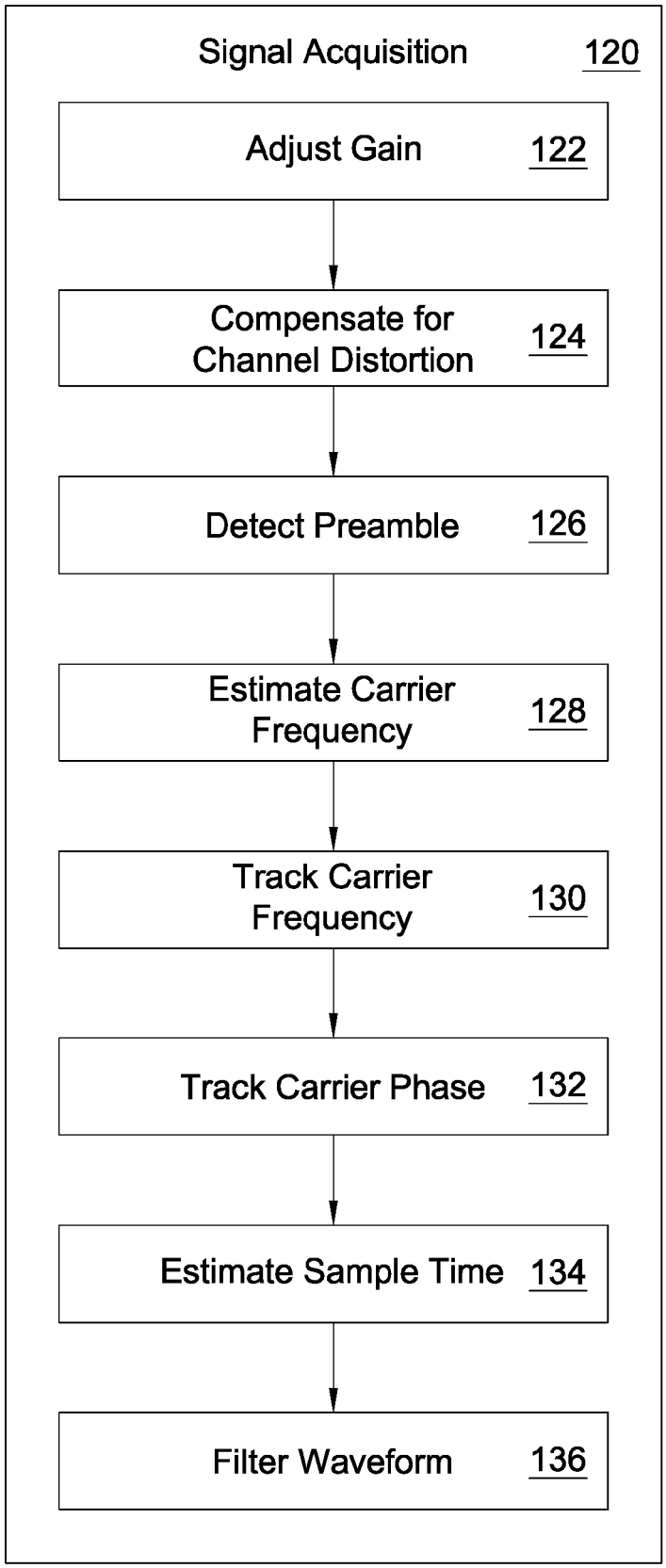
FIG. 8 is a flow chart illustrating one embodiment of a data acquisition process used by a burst modem in accordance with the invention.

Referring to FIG. 8, a signal acquisition process 120 may include a number of steps, although the process 120 does not necessarily all of the steps presented herein or in the same order. The signal acquisition process 120 may be implemented by a burst modem 40 or other hardware or software in a node 18. For example, a signal acquisition process 120 may begin by adjusting 122 the gain of an incoming data signal. As was previously explained, due to inconsistent spacing between nodes 18, attenuation in the transmission cable or transmission elements 28, the dynamic range of data signals received by a modem 40 may be substantial. Thus, the gain of the incoming signal must be adjusted to fall within the operating range of the modem 40 and other hardware.

Likewise, the data acquisition process 120 may compensate 124 for channel distortions. As is typical in most systems that recover digital data from a modulated signal, channel equalization is an important step 124. Channel equalization refers to the process of compensating for the effects of changing channel characteristics and for disturbances in the data transmission channel. The equalization process typically involves calculating the transfer function of a transmission channel and applying the inverse of the transfer function to an incoming signal to compensate for the effects of channel distortion and disturbances.

As previously mentioned, the signal acquisition process 120 includes a step for detecting 126 a data packet. The modem 40 must be able to differentiate an incoming data signal from noise or other disturbances on the transmission line. In some cases, the modem 40 may detect an incoming data packet or signal by measuring the correlation of a preamble 102 or other part of the packet with a stored reference code.

The signal acquisition process 120 may also include steps to estimate 128 the carrier frequency, track 130 the carrier frequency, track 132 the carrier phase, and estimate 134 times to sample symbols. In selected embodiments, these tasks may be achieved in part by using a correlator and various carrier and timing loops. Unlike some continuous modem applications, burst modems must acquire a data signal or data packet extremely quickly. Thus, high-speed acquisition processes are needed to quickly estimate both the carrier frequency and phase, and the sample timing frequency and phase. In most cases this can be accomplished with various loops that converge very quickly to acquire a packet or signal.

A signal acquisition process 120 may include filtering the received signal or packet. This usually requires filtering 136 or processing the received signal in a way that maximizes a transmission system's bit-error performance. This can be accomplished in part by maximizing the ratio of the signal power to noise, interference, and distortion. A matched filter or adaptive equalizer is often a good solution for performing this task.

Figure 9:
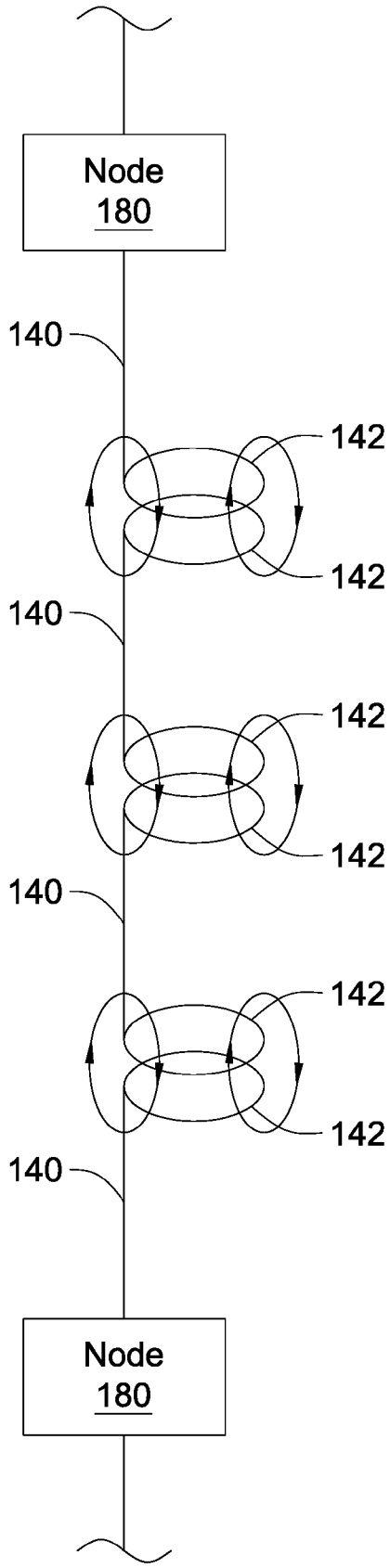
FIG. 9 is a schematic block diagram illustrating one embodiment of a channel used to transmit data in a downhole network.

Referring to FIG. 9, in order to properly design a burst modem 40 for operation in a downhole-drilling network 17, the characteristics of the channel should be examined closely. For example, in a downhole network 17, the channel may include hardware, such as the transmission line 140 integrated into the drill pipe, transmission elements 142 for transmitting signals across the tool joints, hardware in the nodes 18 including analog hardware in the modem 40, and the like. The design of a burst modem 40 should take into account the uncertainty in the burst's arrival time, the signal amplitude, the carrier frequency, the sample timing, and the like. The modem design should also take into account issues such the bit energy to noise power ratio, types of fading or multipath delay, distortion, signal interference, and the like, that may be present in the channel.

Figure 10:
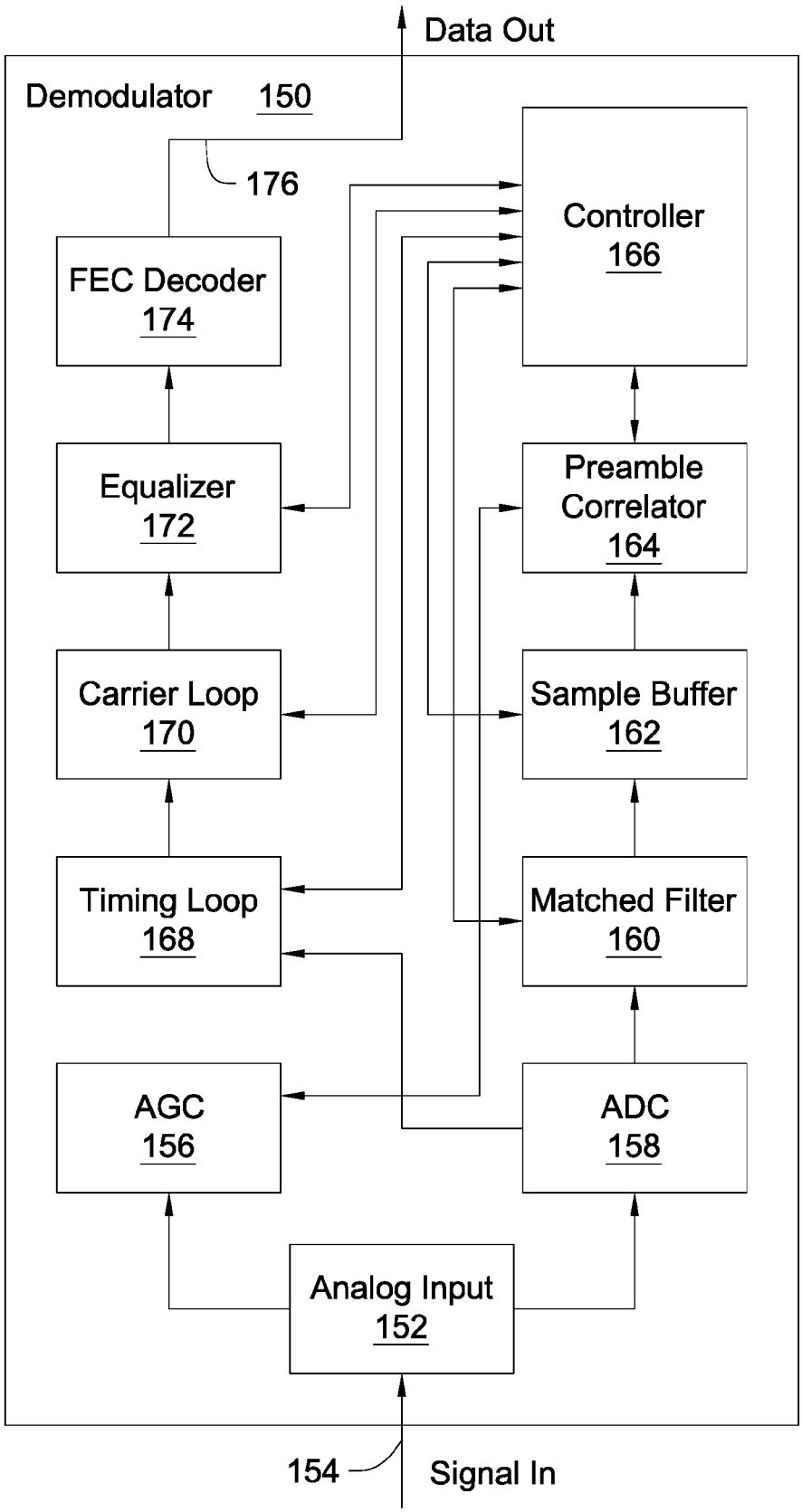
FIG. 10 is a schematic block diagram illustrating one embodiment of a demodulator in accordance with the invention.

Referring to FIG. 10, one embodiment of a burst demodulator 150 is illustrated. The embodiment simply represents one example of various components that may be included in a burst demodulator 150 in accordance with the present invention, and is not intended to limit the scope of the present invention. The components described herein do not necessarily represent an exhaustive or complete list of components that may be included in a demodulator 150, but are simply presented to facilitate a discussion of various demodulator components that may be used in a burst modem 40. For example, a demodulator 150 may include an analog input 152 to receive a signal 154 from a downhole channel. An automatic gain control circuit 156 may monitor the analog input 152 to automatically adjust the power level of incoming signals 154 to fall within the demodulator's operating range. An analog to digital converter 158 may also receive the analog input signal 154 to convert the incoming analog waveform into a digital signal.

The digital signal may be passed through a matched filter 160 to optimize the power to noise ratio of the signal. This signal may be temporarily stored in a sample buffer 162 and passed to a preamble correlator 164. If the correlator 164 detects the preamble 102 of a data packet, a controller 166 may than begin to process samples read from the sample buffer 162, using a timing loop 168, a carrier loop 170, an equalizer 172, a forward error correction decoder 174, or other hardware, to effectively process and extract data from the incoming signal. The resulting data 176 may then be output from the demodulator 150 to higher layers of the protocol stack.

Figure 11:
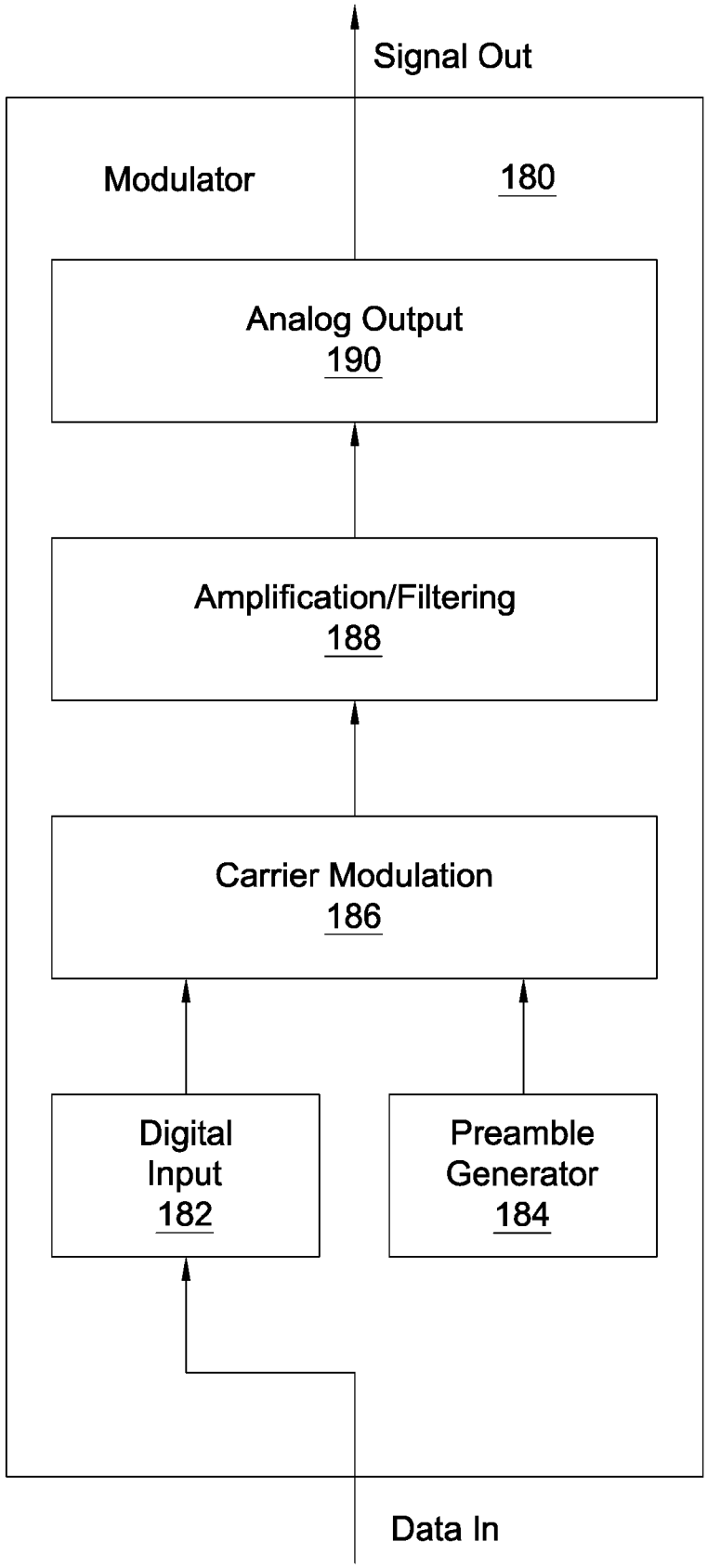
FIG. 11 is a schematic block diagram of one embodiment of a modulator in accordance with the invention.

Referring to FIG. 11, in selected embodiments, a modulator 180 may include a digital input 182, to receive data, and a preamble generator 184. The digital data and preamble may be combined to form a data packet. This data packet may then be modulated 186 onto a carrier at a selected frequency and symbol timing. This analog signal may then be amplified 188 and filtered 188, as needed. The modulator 180 may then output 190 the resulting analog signal to a transmission line 140 where it may be transmitted over a desired channel.

The present invention may be embodied in other specific forms without departing from its essence or essential characteristics. The described embodiments are to be considered in all respects only as illustrative, and not restrictive. The scope of the invention is, therefore, indicated by the appended claims, rather than by the foregoing description. All changes within the meaning and range of equivalency of the claims are to be embraced within their scope.

The invention claimed is:

1. A downhole drilling system, the system comprising: a drill string comprising a plurality of components; a transmission line integrated into each of the components of the drill string and inductive couplers used to transmit signals across joints between the components; and a plurality of network nodes installed at selected intervals along the drill string, wherein the plurality of network nodes are adapted to communicate with one another, through the transmission line and the inductive couplers, using burst modulation techniques.

2. The system of claim 1, wherein each of the plurality of network nodes further comprises at least one burst modem to implement the burst modulation techniques.

3. The system of claim 2, wherein the plurality of network nodes are configured to communicate with one another by transmitting data packets therebetween.

4. The system of claim 3, wherein the at least one burst modem further comprises an automatic gain control mechanism to automatically adjust the gain of data packets received thereby.

5. The system of claim 4, wherein each of the data packets further comprises a preamble.

6. The system of claim 5, wherein the preamble further comprises an unmodulated carrier portion to enable the at least one burst modem to estimate the carrier frequency of the data packet.

7. The system of claim 5, wherein the preamble further comprises a timing sequence portion to enable the at least one burst modem to estimate the timing of symbols in the data packet.

8. The system of claim 5, wherein the preamble further comprises a unique code to enable the at least one burst modem to detect a data packet transmitted over the transmission line.

9. The system of claim 1, wherein the burst modulation techniques are selected from the group consisting of burst quadrature phase shift keying, burst quadrature amplitude modulation, burst amplitude shift keying, burst phase shift keying, burst on-off keying, burst pulse code modulation, burst frequency shift keying, burst pulse amplitude modulation, burst pulse position modulation, burst pulse duration modulation, burst phase modulation, burst pulse duration modulation, burst pulse width modulation, and combinations thereof.

10. The system of claim 1, wherein the plurality of network nodes are configured to interface to at least one of downhole tools and sensors.

11. A downhole drilling system, the system comprising: a drill string comprising a plurality of components; a transmission line integrated into each of the components of the drill string and inductive couplers used to transmit signals across joints between the components; and a plurality of network nodes installed at selected intervals along the drill string, wherein: the plurality of network nodes are adapted to communicate with one another through the transmission line and the inductive couplers; and the plurality of network nodes further comprise burst modems, wherein the plurality of network nodes are configured to communicate with one another using the burst modems.

12. The system of claim 11, wherein the plurality of network nodes are configured to communicate with one another by transmitting data packets therebetween.

13. The system of claim 12, wherein the burst modems further comprise automatic gain control mechanisms to automatically adjust the gain of data packets received thereby.

14. The system of claim 13, wherein each of the data packets farther comprises a preamble.

15. The system of claim 14, wherein the preamble further comprises an unmodulated carrier portion to enable the burst modems to estimate the carrier frequency of the data packet.

16. The system of claim 14, wherein the preamble farther comprises a timing sequence portion to enable the burst modems to estimate the timing of symbols in the data packet.

17. The system of claim 14, wherein the preamble further comprises a unique code to enable the burst modems to detect data packets transmitted over the transmission line.

18. The system of claim 11, wherein the burst modems use a modulation technique selected from the group consisting of burst quadrature phase shift keying, burst quadrature amplitude modulation, burst amplitude shift keying, burst phase shift keying, burst on-off keying, burst pulse code modulation, burst frequency shift keying, burst pulse amplitude modulation, burst pulse position modulation, burst pulse duration modulation, burst phase modulation, burst pulse duration modulation, burst pulse width modulation, and combinations thereof.

19. The system of claim 11, wherein the plurality of network nodes are configured to interface to at least one of downhole tools and sensors.

20. A downhole drilling communications network, the network comprising: a top hole node comprising a first burst modem; a bottom hole node comprising a second burst modem; and an intermediate node located between the top hole node and the bottom hole node, wherein the intermediate node further comprises a third burst modem configured to relay data between the first burst modem and the second burst modem wherein the nodes are in communication with each other over a transmission line and a plurality of inductive couplers.

* * * * *